US005249933A

United States Patent [19]

Moody

[11] Patent Number: 5,249,933

[45] Date of Patent: Oct. 5, 1993

[54] SUBMARINE EXTERNAL HYDRAULIC FLUID - ISOLATED SYSTEM

[75] Inventor: Paul E. Moody, Barrington, R.I.

[73] Assignee: The United States of America as represented by the Secretary of the Navy, Washington, D.C.

[21] Appl. No.: 955,208

[22] Filed: Oct. 1, 1992

[51] Int. Cl.[5] ..... F04B 17/00; B63G 8/00

[52] U.S. Cl. ..... 417/404; 114/312; 114/319

[58] Field of Search ..... 417/404, 390, 383; 60/473, 476; 114/312, 332, 337, 319, 150; 440/61

[56] References Cited

U.S. PATENT DOCUMENTS 3,447,552 6/1969 Grosson ..... 114/337 X
3,649,136 3/1972 Ruidisch ..... 417/404
3,775,028 11/1973 Davis ..... 417/404

*Primary Examiner*—Richard A. Bertsch
*Assistant Examiner*—Peter Korytnyk
*Attorney, Agent, or Firm*—Michael J. McGowan; Prithvi C. Lall; Michael F. Oglo

[57] ABSTRACT

A submarine is equipped with a conventional main hydraulic system and has at least one hydraulic actuator located outside the vessel's pressurized hull where it is susceptible to contamination of its hydraulic fluid. The actuator is operated from an isolation system that includes a slave piston driven by a power piston from the main hydraulic system to keep a desired pressure in the secondary system by operating the power piston only as required for this purpose. Both power and slave piston positions are related and a two position limit switch is tripped by switch actuators linked to these pistons for operating the power and slave pistons. This isolation system prevents any contaminants in the external system from contaminating the internal system.

7 Claims, 2 Drawing Sheets

SUBMARINE EXTERNAL HYDRAULIC FLUID - ISOLATED SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF INVENTION (1) Field of the Invention

This invention relates generally to submarines having at least one internal hydraulic system with pressure and return lines connecting a source of hydraulic pressure to various hydraulically operated devices outside the vessel's hull. More specifically, this invention deals with an external hydraulic system operated from the internal hydraulic system through a novel power piston/cylinder and slave piston/cylinder together with a simplified external hydraulic system that does not require a pump and other components for regulating the hydraulic fluid in the external system.

(2) Description of the Prior Art

A submarine generally has two hydraulic systems with cross connect lines which can be opened in the event that one should be inoperable for any reason. Both such systems operate the internal components of the submarine such as valves and emergency closure devices or the like.

An external hydraulic system is independently operated from the two internal systems. Externally operated hydraulic components outside the vessel's hull run the risk of contaminating the hydraulic fluid with seawater or other foreign material picked up by the external hydraulic components. Thus, an external hydraulic system with all the necessary hydraulic pump and control components is required in addition to the submarine internal systems.

Mechanically connected pistons operating in the same or tandem cylinders represents one approach to achieving a pumping action either for compressed air applications as suggested in U.S. Pat. No. 1,281,490 or more recently in U.S. Pat. No. 4,830,583. These prior art patents fail to show or to suggest that the fluid being handled by the one piston be so isolated from the fluid being handled by the second piston that the latter fluid can never contaminate the fluid in the power cylinder.

Double acting tandem piston pumps for providing booster pressures or to effect pulsating pressure in a second fluid are also known from prior art patents such as U.S. Pat. No. 4,674,958 and No. 3,700,360.

Somewhat more relevant but still falling short of suggesting the invention disclosed and claimed in the present application are U. S. Pat. Nos. 3,649,136, 3,790,310, and 4,223,706. These patents do suggest tandem piston cylinders mechanically connected by means of a common piston rod for operation in separate cylinders whereby separate fluids can be handled in each fluid system. U.S. Pat. No. 3,649,136 shows in FIG. 3 a control system whereby the power piston is reciprocated at a predetermined rate. There is no suggestion in this prior art patent of providing for piston movement solely to maintain a predetermined pressure in the secondary fluid. So too, U.S. Pat. No. 3,790,310 suggests that the power piston be reciprocated cyclically at a known rate to provide compressed air to a receiver. This air compression function is similar to that suggested in U.S. Pat. No. 1,281,490, and fails to show or suggest the concept of providing an isolated secondary hydraulic fluid system at least partly in the environment outside of a submarine's pressurized hull so as to achieve maintenance of a known pressure in the secondary hydraulic system that may be subjected to contamination as for example by seawater at one or more actuators associated with components external to the vessels hull U.S. Pat. No. 4,223,706 is similar to the system described in U.S. Pat. No. 3,649,136 whereby reciprocation of the tandem piston/cylinder combination is provided for in a cyclical fashion in at a predetermined rate rather than to achieve a predetermined pressure in a secondary hydraulic system that includes at least a portion thereof outside the protected environment inside the vessel itself.

Finally, U.S. Pat. No. 4,473,751 shows a tandem piston/cylinder arrangement for achieving cyclical motion of a piston rod which rod is used to provide relatively small amounts of electrical power through corresponding motion of an armature in a magnetic field such that electrical energy can be utilized in an environment which would otherwise be hostile to the hydraulic fluid in the tandem piston/cylinder setup. This disclosure merely shows the tandem piston arrangement used as a pump for a single fluid, and the isolation achieved is only as a result of transmitting motion of the piston rod to the armature of an electromagnetic machine. There is no secondary hydraulic system provided in the hostile environment as shown and described in the subject application.

SUMMARY OF INVENTION

The present invention seeks to obviate the need for an independent self-contained external hydraulic system capable of operating components external to the vessels pressure hull.

In accordance with the present invention a hydraulically operated two-way power piston/cylinder is coupled to the pressure and return lines of the internal hydraulic system by a first two-way valve, and a slave piston/cylinder is mechanically connected to said two-way power piston/cylinder by a second two-way valve for providing hydraulic fluid to secondary hydraulic pressure return lines outside the submarines hull. Means is provided for coupling the first and second two-way valves so that the power piston is moved sequentially in one and an opposite direction to maintain a predetermined pressure in said secondary pressure line from one side or the other side of said slave piston.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
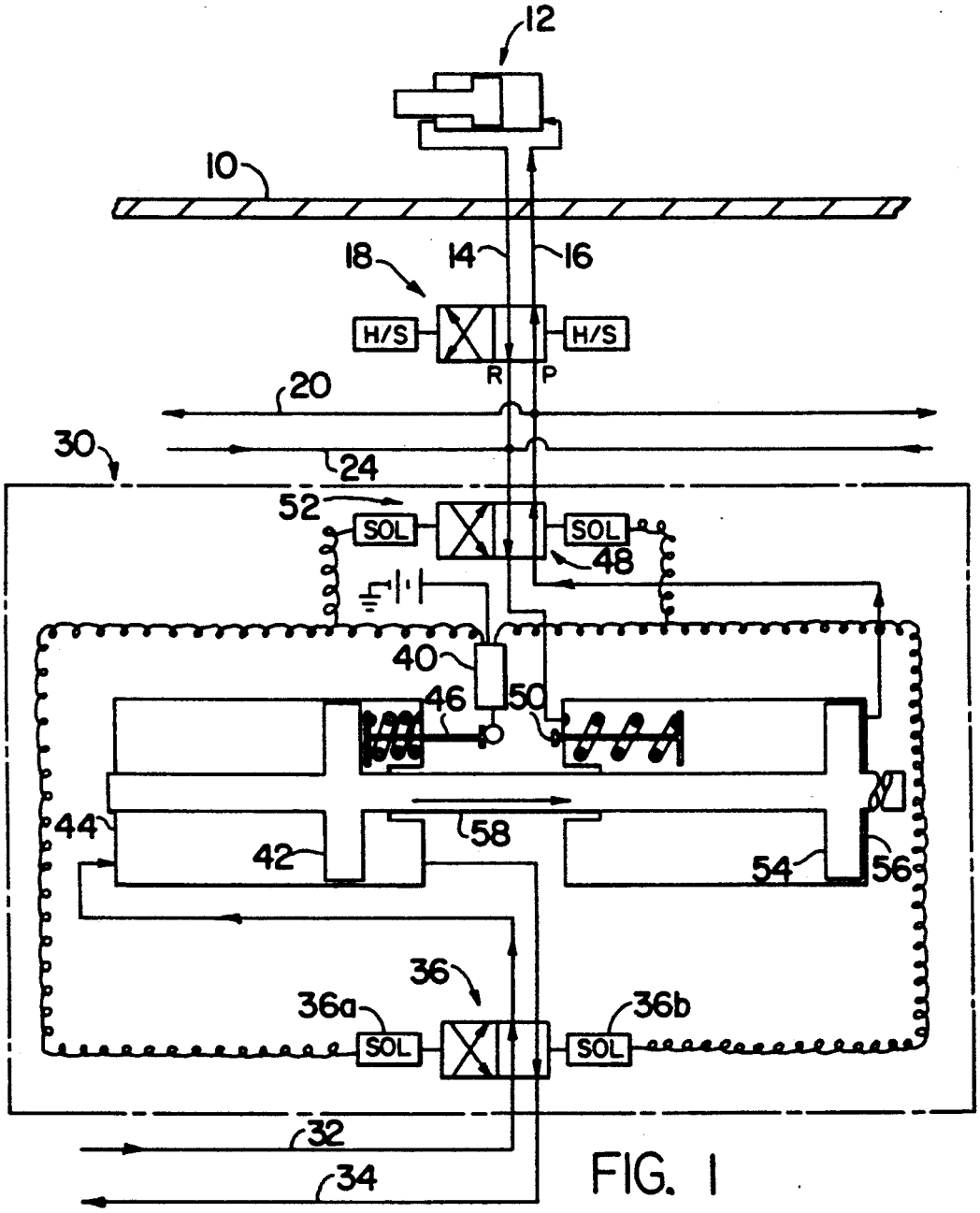
FIG. 1 shows in schematic fashion a portion of the submarine's main internal hydraulic system, and also shows a single actuator provided externally of the vessels hull for operation by hydraulic fluid from a secondary external hydraulic system that is operated from the main hydraulic system by a power piston/cylinder and mechanically connected slave piston/cylinder.

Turning now to FIG. 1 in greater detail, the submarine hull is indicated generally at 10 with a typical actuator 12 illustrated externally of the pressure hull. This actuator 12 can be seen to have its movable portion 12*a* exposed to the seawater environment and therefor the fluid inside the actuator is subject to being contaminated therewith, the result being that these contaminates eventually find their way into the lines 14 and 16 which serve to drive the actuator 12 to and from the position shown. A control valve 18 is provided for this purpose and may be operated from the vessel's hydraulic system, or operated electrically, or might be operated manually.

The external hydraulic system into which the actuator 12 is connected includes conventional pressure and return lines 20 and 24 respectively, not unlike those of any conventional hydraulic system. However, the present invention permits these pressure and return lines to be provided with fluid from a source that is part of an isolation system 30 to be described.

The ships main internal hydraulic system is represented schematically by the ship's supply pressure line 32 and the ships return line 34. Other conventional components of the ships main internal hydraulic system are not illustrated but it will be apparent that such a system includes a pump and suitable control components all of which are required to provide hydraulic fluid at the desired pressure in the pressure line 32 and to provide for return of hydraulic fluid in the return line 34 to a reservoir or the like.

In accordance with the present invention hydraulic fluid in the ship's pressure and return lines is isolated from the fluid provided in the external hydraulic system so that no chance of contamination is permitted as a result of the hostile environment for the external actuator 12 outside the ship's pressure hull 10.

Figure 2:
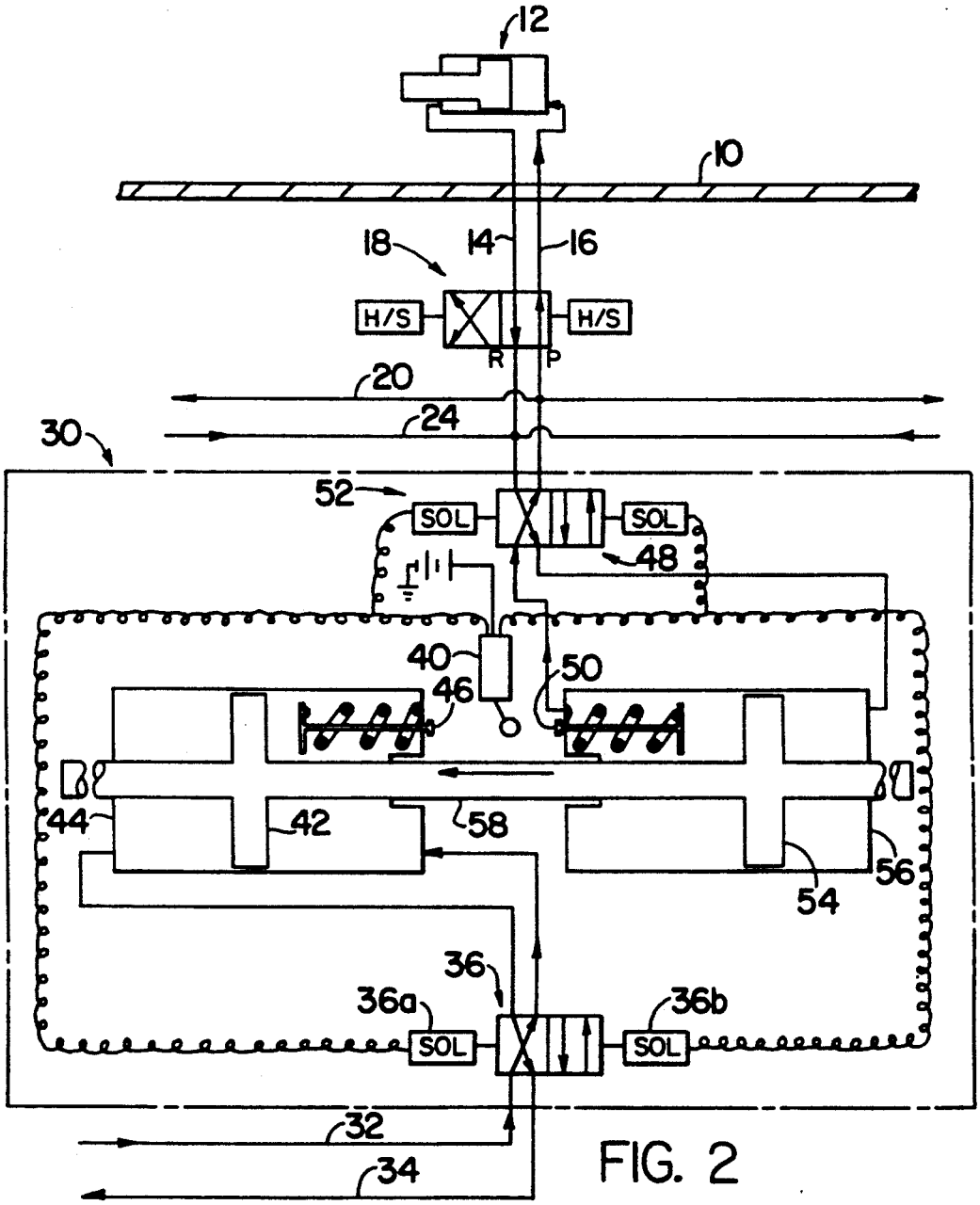
FIG. 2 is similar to FIG. 1, but shows the power piston during its return stroke.

The isolation system 30 includes a first two-way valve 36 that is electrically operated from and to the positions illustrated for it in FIGS. 1 and 2 by electrical solenoids 36*a*, 36*b* which solenoids are selectively connected to a source of electrical energy through a two position switch 40.

As shown in FIG. 1 fluid pressure in the line 32 is provided to the left-hand side of a power piston 42 which is slidably received in a power cylinder 44. In the position shown for it in FIG. 1 the power piston 42 is at or near its right-hand limit of travel with the result that a switch actuator rod 46 will have engaged the arm of switch 40 to achieve switching of the contacts (not shown) of switch 40 from a position where solenoid 36*b* is energized (as shown in FIG. 1) to a position where the solenoid 36*a* is energized as illustrated in FIG. 2.

Upon energizing of solenoid 36*a* two-way valve 36 shifts from the position shown in FIG. 1 to that shown in FIG. 2, maintaining a predetermined pressure in the line 32 to the right-hand side of the power piston 42 and causing movement of the power piston 42 toward the left.

In accordance with the present invention a slave piston/cylinder 54, 56 is mechanically connected to the power piston/cylinder so that movement of the one necessarily creates movement of the other. Thus, the slave cylinder acts as a pump in providing secondary hydraulic fluid under pressure to pressure line 20 of the external hydraulic system. The pressure of the secondary fluid is maintained by providing a second two-way valve 48 in the external hydraulic system for control of the fluid pressure produced in the slave piston/cylinder.

A second switch actuator 50 is provided in the slave cylinder for achieving the necessary switching of the arm of switch 40 to achieve a second stroke for the power piston 42 similar to that described previously (that is, movement of the power piston 42 from the left to the right in FIG. 1). These switch actuators 46 and 50 provide a lost motion mechanism between switch 40 and the pistons 42 and 54.

The slave cylinder is a mirror image of the power cylinder and movement of the power cylinder to the right by the force of fluid injected into the power cylinder from pressure line 32 achieves a corresponding pressure from the right-hand side of the slave piston. By the same token, movement of the power cylinder to the left as shown in FIG. 2 achieves the desired pressurization of fluid in the external hydraulic system at the left-hand side of the slave piston. Pressure from one or the other of both sides of the slave cylinder is routed to the desired side of the actuator 12 by the second two-way valve indicated generally at 52. This two-way valve 52 is similar to the two-way valve 36 described previously, and each of these two-way valves, 36 and 52 is operated under the control of the limit switch 40 so that these valves move in synchronized relationship with respect to one another during the sequential operation of the power and slave piston/cylinder combinations.

A single shaft is provided for mechanically connecting the power and the slave piston but it will be apparent that other mechanical connections might be provided, for example these power and slave piston/cylinders could be provided side-by-side with their shafts physically interconnected for movement in corresponding directions.

Another alternative that would be possible within the scope of the present invention is to provide for the control of the two-way valves to be other than that shown, and perhaps to include a purely mechanical linkage rather than the electromechanical means shown here (i.e. with switch 40 and the four solenoids). So too, the switch 40 could be attached to the shaft which mechanically connects the power piston and slave piston, such a switch being tripped by abutments provided on the ends of the cylinders rather than by the spring loaded actuators as shown.

Although two-way valves are shown and described other control valves could be adapted for use in a system in accordance with the present invention. One possibility might be to provide a single duplex control valve rather than the two control valves shown. Since both control valves shown operate in synchronism with one another a duplex valve could be adapted for use provided only that the fluid being handled from the ship's hydraulic system by kept isolated from the fluid being handled by the external hydraulic system.

In operation, and as the fluid pressure in actuator 12 is reduced by losses in the external system itself, slave piston 54 eventually reaches one of two limit positions that will cause switch 40 to be tripped so that pressure in the ship's main system can cause power piston 42 to move creating corresponding movements of the slave piston 54. Thus, fluid pressure in the external system is continuously maintained as long as the ship's primary or internal system is operating.

In light of the above, it is therefore understood that within the scope of the appended claims, the invention may be practiced otherwise than as specifically described.

What is claimed is:

1. In combination with a submarine having a pressure hull and having hydraulic components external to the pressure hull that require operation in a seawater environment and having at least one internal hydraulic system with pressure and return lines connecting a source of hydraulic pressure to various hydraulically operated devices inside the vessel, said combination comprising:

a hydraulically operable two-way power piston/cylinder inside said pressure hull;

a first valve coupling said two-way power piston/cylinder to the pressure and return lines of the one hydraulic system inside said pressure hull;

a slave piston/cylinder mechanically connected to said two-way power piston/cylinder inside said pressure hull;

secondary hydraulic pressure and return lines outside said pressure hull;

a second valve coupling said slave piston/cylinder to said secondary hydraulic pressure and return lines outside said pressure hull; and means coupling said first and second valves so that said power piston is moved sequentially in one and an opposite direction to pressurize said secondary hydraulic pressure line from one side or the other side of said slave piston and thereby maintain a predetermined pressure in said secondary hydraulic pressure line.

2. The combination according to claim 1 wherein an electric circuit is provided to couple said first and second valves, and wherein said circuit includes at least one limit switch provided intermediate said power piston/cylinder and said slave piston/cylinder inside said pressure hull, and limit switch actuators provided in said power cylinder and slave cylinder for sequential operation of said limit switch, said limit switch operating said first and second valves to move said power piston sequentially in one and an opposite direction to maintain a predetermined pressure in said secondary hydraulic pressure line.

3. The combination according to claim 1 wherein said means coupling said first and second valves comprises an electrical control system including at least one limit switch provided intermediate said power piston/cylinder and said slave piston/cylinder, said first and second valves being electrically controlled two-way solenoid valves.

4. The combination according to claim 1 wherein said power piston and slave piston are mechanically connected as a result of sharing a common piston rod, said power and slave cylinders being spaced from one another and slidably receiving said common piston rod.

5. The combination according to claim 1 wherein said mechanically connected power piston/cylinder and slave piston/cylinder have their respective pistons mechanically connected to each other, and said means coupling said first and second valves including a two position switch provided between said respective cylinders, and mechanical means for sequentially moving said switch from one to the other of its two positions as said pistons approach opposed travel limits, and an electric circuit including said two position switch for controlling said first and second valves.

6. The combination according to claim 5 wherein said mechanical means for sequentially moving said switch comprises first and second switch actuators, each actuator including a lost motion means provided between the actuator portion that engages the switch and the mechanically connected power and slave piston cylinders.

7. The combination according to claim 5 wherein said first and second valves are two-way valves that are electrically controlled for simultaneous operation, and a control valve for each external hydraulic accessory for coupling that accessory to said secondary hydraulic pressure and return lines.

* * * * *